United States Patent [19]

Honda et al.

[11] Patent Number: 4,894,956

[45] Date of Patent: Jan. 23, 1990

[54] APPARATUS AND METHOD FOR SLICING A WAFER

[75] Inventors: Katsuo Honda; Susumu Sawafuji, both of Mitaka, Japan

[73] Assignee: Tokyo Semitsu Co., Ltd., Japan

[21] Appl. No.: 344,956

[22] Filed: Apr. 28, 1989

Related U.S. Application Data

[62] Division of Ser. No. 150,376, Jan. 29, 1988.

[30] Foreign Application Priority Data

Oct. 29, 1987 [JP] Japan ..... 62-274536
Oct. 29, 1987 [JP] Japan ..... 62-274537

[51] Int. Cl.[4] ..... B24B 7/00
[52] U.S. Cl. ..... 51/5 B; 51/323
[58] Field of Search ..... 51/5 B, 5 C, 323; 125/13 R, 20

[56] References Cited

U.S. PATENT DOCUMENTS 3,828,758 8/1974 Cary ..... 51/3 X
4,084,354 4/1978 Grandia et al. ..... 125/13 R X
4,756,796 7/1988 Saitou ..... 51/5 C

FOREIGN PATENT DOCUMENTS 0221454 10/1986 European Pat. Off. .
62-106207 5/1986 Japan .
61-114813 6/1986 Japan .
62-96400 5/1987 Japan .
62-224537 10/1987 Japan .
62-264835 11/1987 Japan .
62-264836 11/1987 Japan .

*Primary Examiner*—Frederick R. Schmidt
*Assistant Examiner*—B. A. Rachula
*Attorney, Agent, or Firm*—Oliff & Berridge

[57] ABSTRACT

In an apparatus and a method for slicing a cylindrical semiconductor ingot into thin wafer pieces using an inner peripheral sliding blade, a grind stone shaft with a grind stone mounted to the tip end thereof is located movably axially within a rotor provided with the inner perpheral sliding blade so that the grind stone shaft and rotor can be rotated integrally but axially movable relative to each other. the grind stone and slicing blade are arranged effieciently so that, after the semiconductor ingot is sliced with the slicing blade, the grind stone approaches the end face of the ingot to grind it. This can save a lapping step, thereby improving working efficiency.

2 Claims, 9 Drawing Sheets

APPARATUS AND METHOD FOR SLICING A WAFER

This is a division of application Ser. No. 07/150,376 filed Jan. 26, 1988.

BACKGROUND OF THE INVENTION

1. Field of the Invention

The present invention relates to an apparatus and a method for slicing a semiconductor wafer and, in particular, to an apparatus and a method for slicing a wafer by cutting thin slices from a cylindrical-shaped semiconductor material in a semiconductor manufacturing process.

2. Description of the Related Art

Conventionally, a slicing machine has been in use, as an apparatus for cutting thin slices from a cylindrical-shaped semiconductor material (such as silicon, synthetic quartz glass or the like) to produce wafers.

However, in some cases, in the above-mentioned conventional slicing machine, a cutting resistance given to a slicing blade can not be maintained in a predetermined constant level due to the wear, or the like of the slicing blade, which is used to cut an ingot. In such cases, as shown in FIG. 9, the slicing blade 100 is caused to move irregularly relative to a slicing direction, so that there are produced curvatures, saw makes and the like 104 on the sliced surface of the wafer 102.

Also, the semiconductor wafers currently made are growing larger in diameter. That is, the further the growth of the semiconductor wafer diameter advances, the greater curvatures are produced on the wafer when the wafer is made by slicing the ingot. Such curvatures can not be corrected by following steps such as a lapping operation and the like.

In view of the above-mentioned circumstances, in Japanese Patent Publication (Laid-Open) No. 61-106207, there is disclosed a method of removing the curvatures and the like on the wafer.

According to the disclosed method, a cup-shaped grind stone is located adjacently to an inner periphery slicing blade of a slicing apparatus and the surface of an ingot to be sliced is surface ground; after then, the ingot is cut into thin slices by the inner periphery slicing blade and the surface of the ingot are then ground by the cup-shaped grind stone. That is, these operations are repeated to manufacture wafers. Since one surface of the sliced wafer has been surface ground, the wafer can be machined in a following step, that is, lapping by the grind stone, into a wafer free from curvatures or the like.

However, in the above-mentioned wafer slicing method disclosed in the above-mentioned Japanese Patent Publication (Laid-Open), there is disclosed no concrete structure in which the inner periphery slicing blade and grind stone are arranged in the limited space of the slicing apparatus. For this reason, there has been desired the development of a wafer slicing apparatus in which the inner periphery slicing blade and grind stone are arranged in an efficient manner.

SUMMARY OF THE INVENTION

The present invention aims at eliminating the drawbacks found in the prior art.

Accordingly, it is an object of the invention to provide a wafer slicing apparatus in which a grind stone and an inner periphery slicing blade are efficiently arranged.

In order to accomplish the above object, according to the invention, there is provided a wafer slicing apparatus which comprises a rotary body, an inner periphery slicing blade mounted to the rotary body for cutting a cylindrical-shaped material into thin slices, a grind stone shaft provided with a grind stone at the leading end thereof and disposed within and coaxially with the rotary body, the grind stone shaft being rotatable integrally with the rotary body and movable axially to advance or retreat the grind stone with respect to the inner periphery slicing blade, and a feed device for moving the grind stone shaft axially.

According to the wafer slicing apparatus of the invention, simultaneously when the inner periphery slicing blade is rotated, the grind stone shaft is rotated integrally with the rotary body, so that the grind stone mounted to the leading end of the grind stone shaft is rotated. Next, the feed device is operated to move the grind stone up to a grinding position. After then, the end surface of the cylindrical-shaped material, that is, ingot is ground by the grind stone and then the ingot is sliced into thin pieces by the inner periphery slicing blade.

In other words, due to the fact that the grind stone shaft is disposed within and coaxially with the rotary body in an axially advancable and retreatable manner and that the surface of the ingot to be sliced can be ground by means of advancement and retreat of the grind stone shaft, the invention can provide a compact wafer slicing apparatus. Also, according to the invention, a lapping step can be saved so that working efficiency can be enhanced.

Also, it is another object of the invention to provide wafer slicing method which can improve working efficiency in slicing wafers.

In attaining the above object, according to the invention, there is provided a wafer slicing method in which a cylindrical-shaped material is cut into a thin slice while it is rotated, next the cylindrical-shaped material is fed a predetermined amount to the direction of the thickness of the slice, the cylindrical-shaped material is cut again into another thin slice, and these operations are repeated to cut the cylindrical-shaped material into thin slices, characterized in that, when the cylindrical-shaped material is fed, the axis of the cylindrical-shaped material is aligned with the annular grind section of a cup-shaped grind stone, and the end surface of the cylindrical-shaped material to be sliced is ground by the grind stone while the cylindrical-shaped material is rotated.

According to the wafer slicing method of the invention, the cylindrical-shaped material, that is, an ingot is cut into a thin slice while it is rotated. Next, when the ingot is fed, the surface of the ingot to be sliced is ground by the grind stone while the ingot is rotated. After then, the ingot is again cut into another thin slice while the ingot is rotated. These operations are repeated to produce wafers. This way of wafer production can improve working efficiency in slicing wafers.

BRIEF DESCRIPTION OF THE DRAWINGS

The exact nature of this invention, as well as other objects and advantages thereof, will be readily apparent from consideration of the following specification relating to the accompanying drawings, in which like reference characters designate the same or similar parts throughout the figures thereof and wherein.

DETAILED DESCRIPTION OF THE INVENTION

Detailed description will hereunder be given of the preferred embodiments of wafer slicing apparatus and method according to the present invention with reference to the accompanying drawings.

Figure 1:
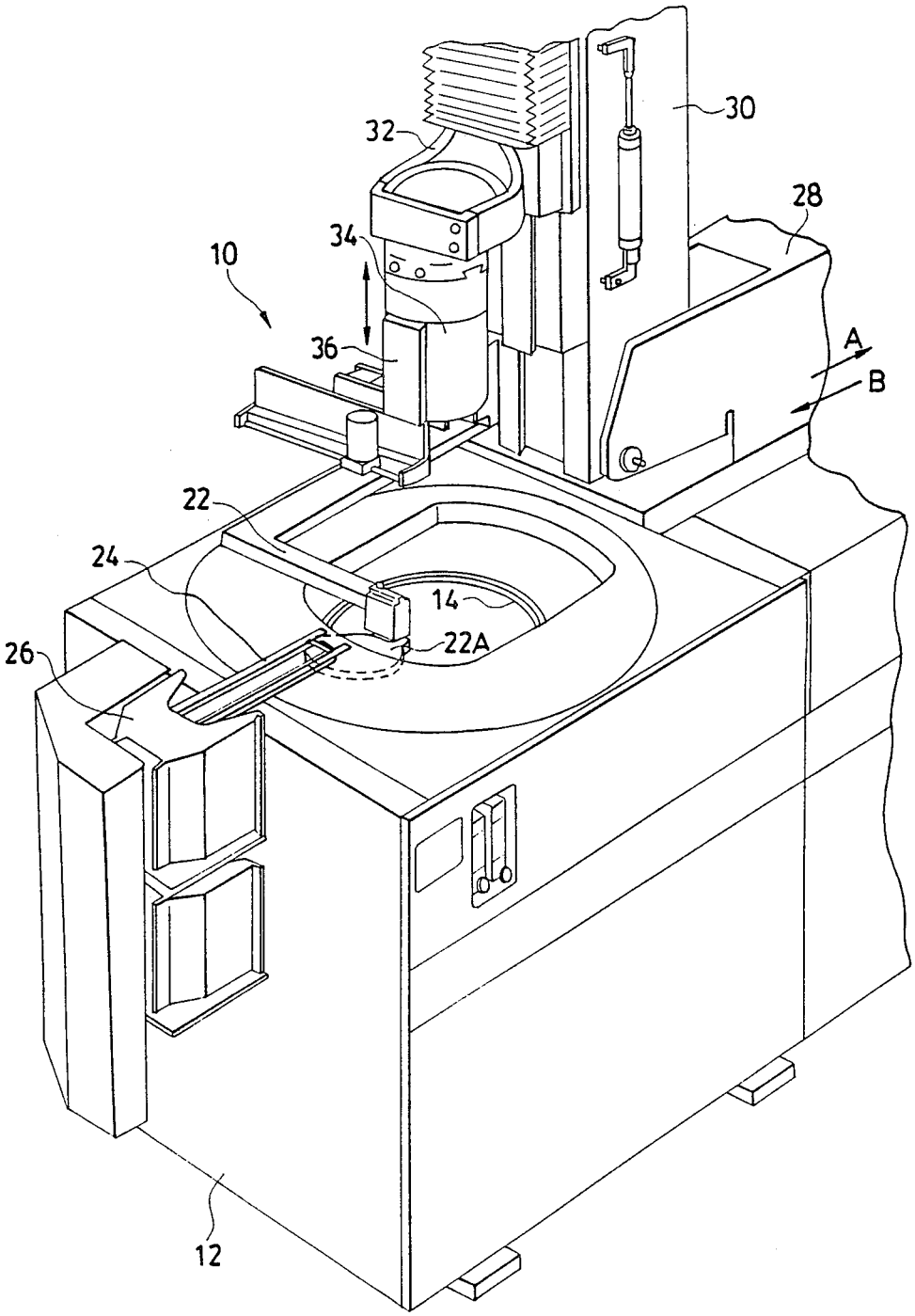
FIG. 1 is a perspective view of a whole wafer slicing apparatus according to the invention.
Figure 2:
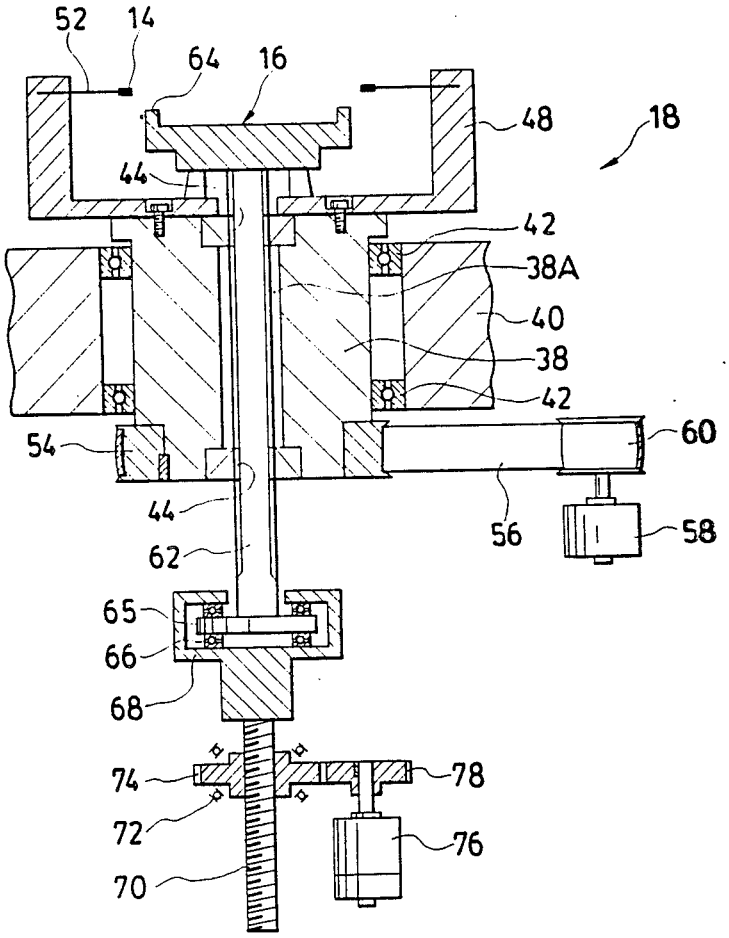
FIG. 2 is a section view of the wafer slicing apparatus according to the invention.

Referring first to FIG. 1, there is shown a perspective view of a whole wafer slicing apparatus according to the present invention. In FIG. 1, reference numeral 10 designates the wafer slicing apparatus and the apparatus 10 includes a main body 12 having an upper surface on which an internal periphery slicing blade 14 is provided. Within the inner periphery slicing blade 14, there is mounted a cup-shaped grind stone 16, which is shown in FIG. 2, such that it is disposed coaxially with the inner periphery slicing blade and is free to rotate. Also, below the grind stone 16, there is provided a rotary mechanism 18 (which is shown in FIG. 2) adapted to rotate the inner periphery slicing blade 14 and the cup-shaped grind stone 16.

Also, there is mounted to the apparatus main body 12 a wafer collect device 22 which is arranged so as to extend from the side face of the main body 12 substantially up to the central portion of the inner periphery slicing blade 14. Further, there are provided a wafer carrier device 24 which is disposed so as to face an adsorber pad 22A provided on the leading end of the wafer collect device 22, and a storage case 26 which is used to store wafers that have been carried by means of the collect device 22.

Moreover, there is supported on the upper surface of the main body 12 a slicing/feeding table 28 in such a manner that it is free to slide in the directions of arrows A, B as shown in FIG. 1, and the table 28 can be moved back and forth by a drive source which is not shown. Also, there is erected a support member 30 on the left end portion of the slicing/feeding table 28. On the front surface of the support member 30, there is supported a feed slider 32 such that it is free to move in the longitudinal direction of the support member 30, that is, in the vertical direction. The feed slider 32 is threadedly engaged with a feed screw (which is not shown) mounted in the longitudinal direction of the support member 30 and, therefore, the feed slider 32 can be moved in the vertical direction by means of rotation of the feed screw. In addition, the feed slider 32 supports an ingot 34 to which a slice base 36 is fixed. Thanks to this, the ingot 34 can be moved in the directions of the arrows A, B (that is, in the slicing directions) as well as in the vertical direction (that is, in the direction for adjustment of the slicing thickness of the ingot).

Referring now to FIG. 2, there is shown a section view to illustrate a rotary mechanism 18 which is used to rotate the inner periphery slicing blade 14 and the grind stone 16. As shown in FIG. 2, a cylinder shaped rotor 38 is mounted to a base section 40, which forms a part of the apparatus main body 12, by means of bearing 42, 42 in such a manner the cylindrical rotor 38 can be rotated freely. There is mounted a chuck body 48 on the upper end portion of the rotor 38. There is fixed to the chuck body 48 a doughnut-shaped blade 52 provided on the inner peripheral surface thereof with the inner periphery slicing edge or blade 14 in such a manner that a predetermined tension is given to the doughnut-shaped blade 52. Also, there is mounted a pulley 54 to the lower end portion of the rotor 38, and a belt 56 is provided so as to extend between the pulley 54 and a pulley 60 connected to a motor 58.

Also in FIG. 2, there is provided a grind stone shaft designated by 62. The grind stone shaft 62 is coaxially inserted into a bore 38A formed in the rotor 38 and is also connected via a spline coupling 44 to the rotor 38 in such a manner that it can be freely moved only in its axial direction. The cup-shaped grind stone 16 is mounted on the upper end portion of the grind stone shaft 62. The grind stone 16 has a grinding section which projects out on the peripheral edge of the grind stone 16, and the whole portions of the grinding section 64 are formed so as to be located on the same plane. Thanks to this, the grind stone 16 can be rotated integrally with the inner periphery slicing blade 14 via the spline coupling 44 and also, when it is given a pressure in the axial direction thereof, it can be moved in the axial direction. Also, to the lower end portion of the grind stone shaft 62, there is mounted a connection plate 65 to which the axial pressure is to be applied. The connection plate 65 is located within a joint casing 68 via a thrust bearing 66. On the other hand, to the lower end surface of the casing 68, there is mounted a feed shaft 70 coaxially with the grind stone shaft 62. The feed shaft 70 is threadedly engaged with the interiors of a feed gear 74 which can be rotated through a bearing 72 in such a manner that the feed shaft 70 can be moved axially. The feed gear 74 can be rotated by a drive gear 78 which is mounted to the output shaft of a motor 76.

Now, description will be given below of the operation of the water slicing apparatus according to the invention that is constructed in the above-mentioned manner.

Figure 3:
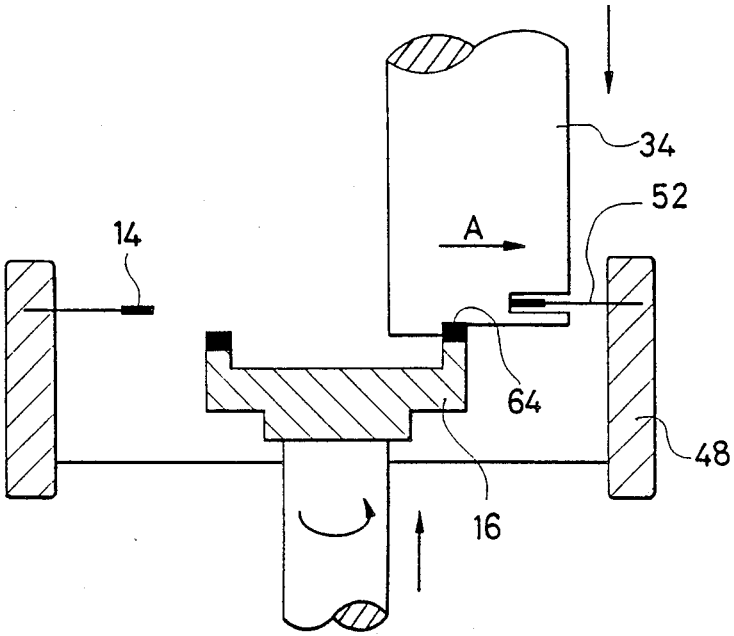
FIG. 3 is a view to illustrate how an ingot is ground and sliced in the wafer slicing apparatus according to the invention.

If the drive motor 58 shown in FIG. 2 is rotated, then the rotor 38 is rotated through the belt 56 and thus the grind stone shaft 62, which is spline coupled to the rotor 38, is also rotated integrally with the rotor 38. Then, the ingot 34 is lowered down and next the motor 76 is rotated to move the feed shaft 70 upwardly in the axial direction through the drive gear 78 and the feed gear 74. As a result of the axially upward movement of the feed shaft 70, the casing 68 is moved upwardly to move the grind stone shaft 62 upwardly in the axial direction. The feed shaft 70 moves the grind stone 16 up to the grinding position and stops there. Next, as shown in FIG. 3, if the ingot 34 is moved in the A direction, then the end face of the ingot 34 is first ground by the grinding section 64 of the grind stone 16, and, slightly later than such grinding by the grind stone 16, the inner periphery slicing blade 14 cuts the ingot 34. In this case, if the cutting is done prior to the grinding then an unreasonable stress is exerted on the wafer under slicing during grinding, with the result that the wafer may be broken or damaged. Therefore, it is desirable that the grinding is carried out first.

After the slicing is ended, the table 28 is moved in the B direction to return to its original position and, on the other hand, the motor 76 is rotated in the opposite direction to move the feed shaft 70 downwardly. As a result of this, the grind stone shaft 62 is caused to follow the feed shaft 70, that is, it moves downwardly. After then, these operations are performed repeatedly so that the ingot 34 is sequentially cut into thin slices.

As can be understood from the foregoing description, due to the fact that the inner periphery slicing blade 14 and the grind stone 16 are arranged on the same axis, a compact wafer slicing apparatus can be supplied as well as a working efficiency can be improved. Also, the mechanisms of the wafer slicing apparatus can be simplified.

In the above-mentioned embodiment, the slicing of the ingot 34 is performed by moving the slicing/feeding table 28 arranged on the side of the ingot 34. But, the present invention is not limited to this, the ingot 34 may be sliced by moving the inner periphery slicing blade 14 without moving the ingot 34.

Figure 4A:
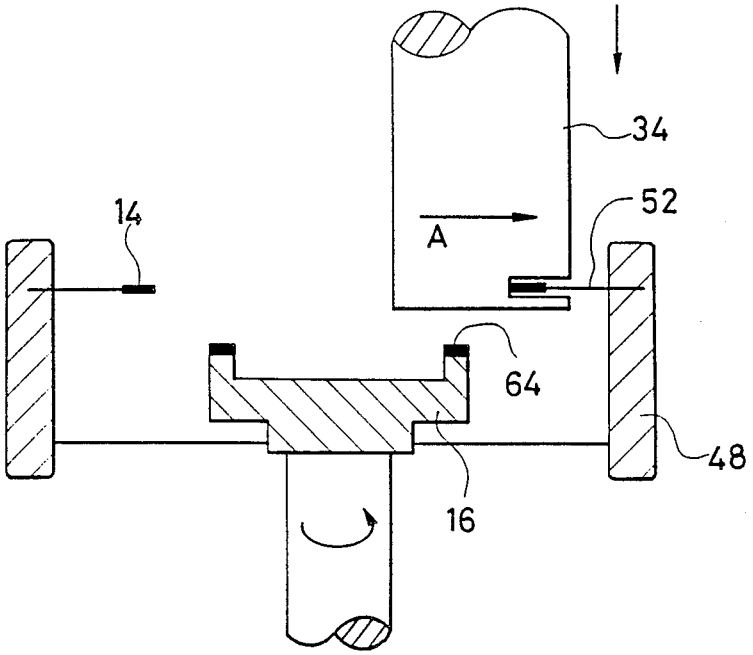
FIGS. 4(*a*) and (*b*) are views respectively to illustrate how the ingot is ground and sliced in other embodiment of the wafer slicing apparatus according to the invention.
Figure 4B:
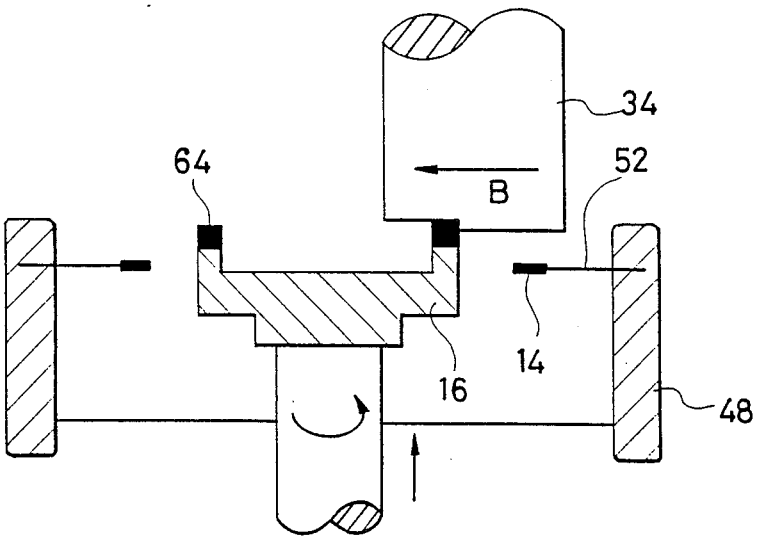

Also, although the ingot 34 is sliced while the ingot 34 is ground in the above-mentioned embodiment, the invention is not limited to this, but, as shown in FIG. 4(*a*), the ingot 34 may be first sliced into a thin piece and then the surface of the ingot sliced may be ground, as shown in FIG. 4(*b*). That is, these operations may be repeated alternately to manufacture wafers.

Figure 5:
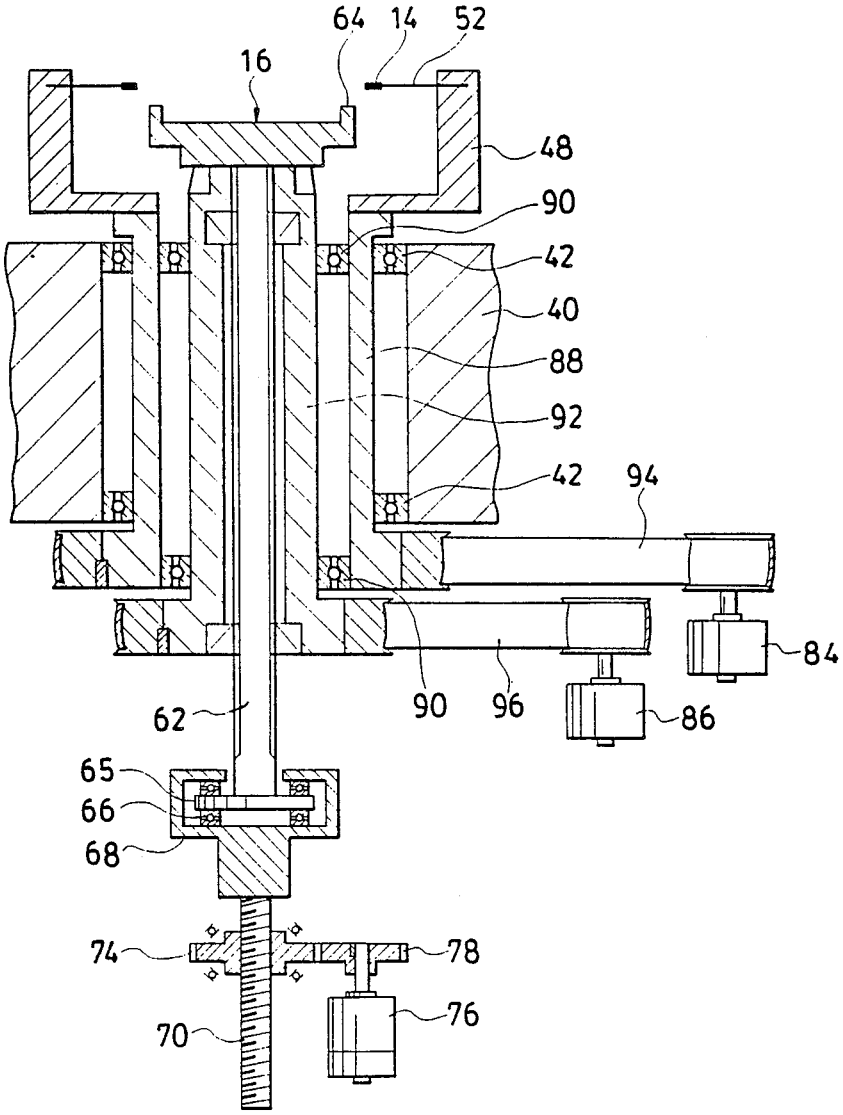
FIG. 5 is a section view of another embodiment of the wafer slicing apparatus according to the invention.

Further, although in the above-mentioned embodiment the grind stone 16 and the inner periphery slicing blade 14 are rotated by a single motor 58, this is not limitative, but, as shown in FIG. 5, the grind stone 16 and the inner periphery slicing blade 14 may be rotated by individual or separate motors 84 and 86, respectively.

Now, description will be given below of a case in which the inner periphery slicing blade 14 and the grind stone 16 are driven by the individual motors 84, 86, respectively. It should be noted here that the description of the same parts as in the above-mentioned first embodiment is omitted here. A first rotor 88 is rotatably mounted to the base section 40 by means of the bearings 42, 42 which are adapted to bear thrust-and-radial-direction loads, respectively. The chuck body 48 is mounted to the leading end of the first rotor 88. Also, there is rotatably mounted a second rotor 92 to the first rotor 88 by means of bearings 90, 90.

In the above-constructed second embodiment according to the invention, the first rotor 88 can be rotated through a belt 94 by means of rotation of the first motor 84, while the second rotor 92 can be rotated through a belt 96 by means of rotation of the second motor 86. Also, the grind stone shaft 62 with the grind stone 16 mounted thereto is rotated integrally with the second rotor 92, as in the above-mentioned first embodiment. With such structure, the amount of rotation of the grind stone 16 and the inner periphery slicing blade 14 can be respectively selected freely, or, independent of each other.

Although in the first embodiment the grind stone shaft 62 is spline coupled to the rotor 38, this is not limitative, but the grind stone shaft 62 may be coupled to the rotor 38 by means of one or more keys.

As has been described heretofore, according to the wafer slicing apparatus of the invention, due to the fact that the grind stone shaft having the grind stone is movably mounted coaxially with and within the rotor for the inner periphery slicing blade and the grind stone can advanced and retreated with respect to the cylindrical-shaped material, a compact wafer slicing apparatus can be provided.

Next, description will be given below of a wafer slicing method according to the present invention with respect to FIGS. 6 through 8.

Figure 6:
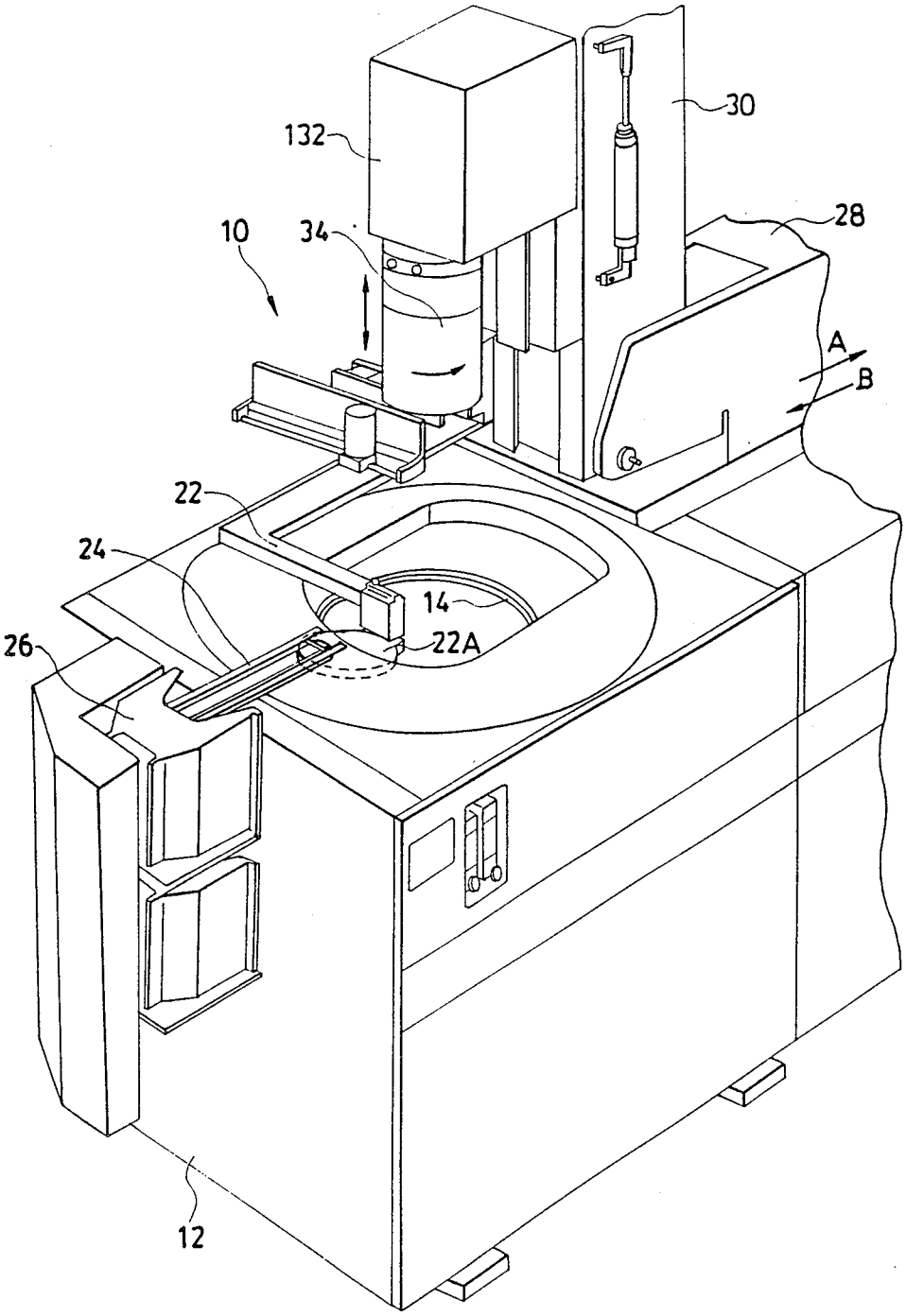
FIG. 6 is a perspective view of a whole wafer slicing apparatus for enforcing wafer slicing method according to the invention.

Referring to FIG. 6, there is shown a perspective view of a whole wafer slicing apparatus which is used to enforce the present method, in which the same parts as in the wafer slicing apparatus shown in FIG. 1 are given the same designations and the description thereof is omitted here. The wafer slicing apparatus in FIG. 6 is different from the wafer slicing apparatus in FIG. 1 in that a motor case 132 is mounted to the front surface of the support member 30 and the motor case 132 has a motor (which is not shown) therein that is used to rotate the ingot 34 about the axis thereof. Also, the motor case 132 is supported through an index slider (not shown) in such a manner that it can be freely moved longitudinally of the support member 30, that is, in the vertical direction. This index slider is threadedly engaged with a feed screw (not shown) mounted longitudinally of the support member 30, and thus the index slider can be moved vertically by rotating the feed screw. Thanks to this, the ingot 34 can be rotated about the axis thereof as well as can be moved in the directions of the arrows A, B (slicing direction) and in the vertical direction (wafer thickness adjusting direction).

Figure 7A:
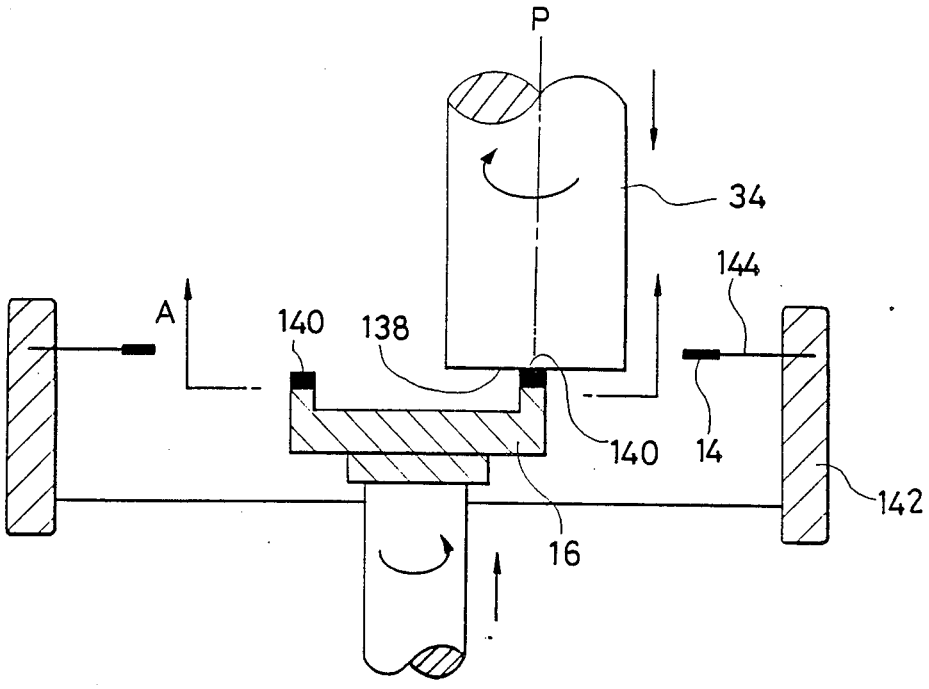
FIGS. 7(*a*) and (*b*) are section views respectively to illustrate embodiment of the wafer slicing method according to the invention.
Figure 7B:
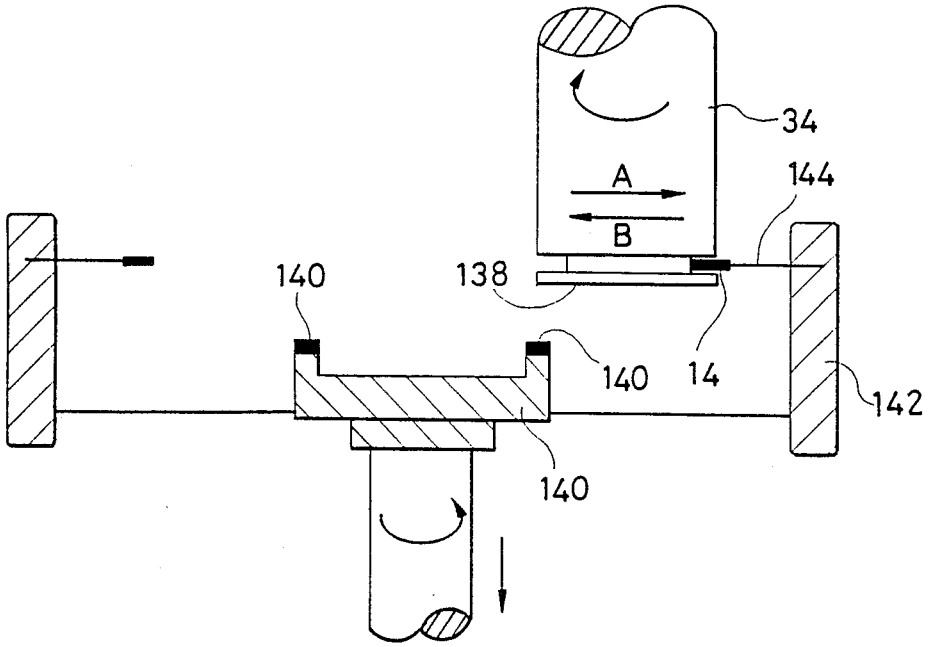
Figure 8:
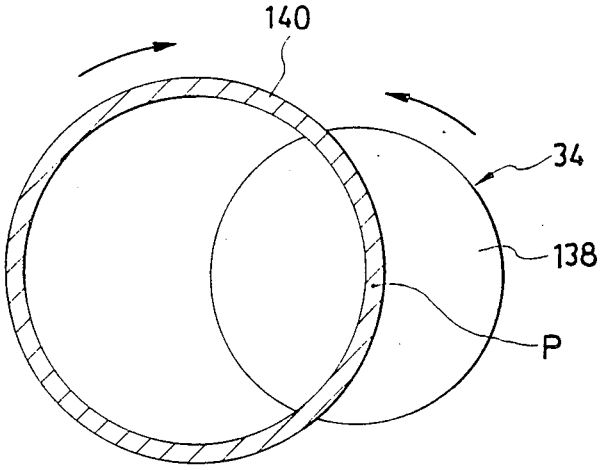
FIG. 8 is a section view taken along the line A—A in FIG. 7(*a*)
Figure 9:
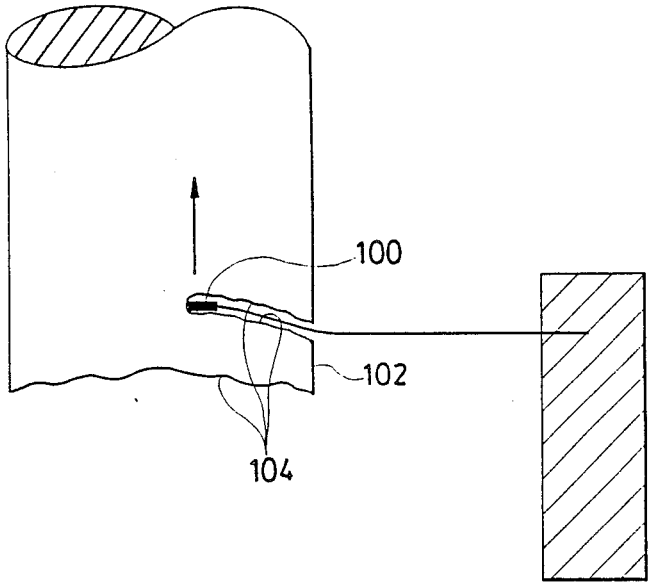
FIG. 9 PRIOR ART
FIG. 9 is a front view to illustrate how to slice an ingot in a conventional wafer slicing machine.

Now, description will be give of the structures of the inner periphery slicing blade 14 and the grind stone 16 in connection with FIGS. 7(*a*) and (*b*). The inner periphery slicing blade 14 is made in the form of a blade 144 fixed to a chuck body 142 with a predetermined tension. Also, the grind stone 16 is made in the form of a cup shape and is provided with an annular grinding section 140 in the peripheral edge thereof. The whole portions of the grinding section 140 is formed so as to provide the same plane.

FIGS. 7(*a*) and (*b*) are respectively views to show a wafer slicing method according to the invention. Specifically, in FIG. 7(*a*), there is shown how to grind the sliced surface 138 of the ingot 34. At first, after the ingot 34 is cut by the inner periphery slicing blade 14, the ingot 34 is moved in the B direction to position its axis P above the grinding section 140 of the grind stone 16. Next, as shown in FIG. 7(*a*), the ingot 34 is rotated and at the same time moved downwardly (in the direction of the grind stone) to carry out a feeding operation. After completion of the feeding operation, the ingot 34 is caused to stop its downward movement. After then, the grind stone 16, while it is rotated, is moved upwardly (in the direction of the ingot 34), so that the sliced surface 138 of the ingot 34 is ground as shown in FIG. 8. In this way, the sliced surface 138 of the ingot 34 can be ground by the grinding section 140 of the grind stone 16 during the feeding operation.

After completion of the grinding, as shown in FIG. 7(*b*), the grind stone 16 is moved downwardly (in the opposite direction of the ingot 34). At the same time, the ingot 34, while it is rotated, is moved in the direction of the arrow A and is then sliced by the inner periphery slicing blade 14. At that time, since the ingot 34 is rotating, the inner periphery slicing blade 14 slices the ingot 34 from the whole periphery thereof bit by bit. In this manner, the inner periphery slicing blade 14 cuts the ingot 34 into thin slices. After every slicing, the ingot 34 is again moved in the B direction and is position above the grinding section 140 of the grind stone 16, so that the grinding is performed when the ingot 34 is fed. After then, these operations are repeated similarly to slice the ingot 34 into thin pieces sequentially.

As mentioned above, thanks to the fact that the sliced surface of the ingot 34 is ground when the ingot 34 is fed, a wafer slicing operation can be carried out efficiently and in a short time.

Also, according to the wafer slicing method of the invention, since the grind stone 16 can be used to grind a projected portion that is left in the central portion of the sliced surface of the ingot 34 due to the rotation of the ingot, such remaining projection as in the prior art can be eliminated.

In the above-described embodiment of the invention, the sliced surface 138 of the ingot 34 is ground by stopping the downward movement of the ingot 34 after completion of the feeding operation and moving the grind stone 16 upwardly. However, the present invention is not limited to this, but the sliced surface 138 of the ingot 34 may be ground by moving the ingot 34 after the grind stone 16 is set at the grinding position, or, the sliced surface 138 may be ground by moving up the grind stone 16 while the ingot 34 is moved downward.

As can be seen from the foregoing description, in the wafer slicing method according to the present invention, since the ingot sliced surface is ground when the ingot is fed in the direction of the wafer thickness, a wafer slicing operation can be performed efficiently.

It should be understood, however, that there is no intention to limit the invention to the specific forms disclosed but on the contrary, the invention is to cover all modifications, alternate constructions and equivalents falling within the spirit and scope of the invention as expressed in the appended claims.

What is claimed is:

1. A wafer slicing method comprising the steps:

locating an inner periphery slicing blade and a grind stone coaxially with each other;

rotating a cylindrical-shaped material and moving it outwardly in the radial direction of said inner periphery slicing blade so as to slice said material into thin pieces; and, matching the axis of said cylindrical-shaped material with the annular grinding section of said cup-shaped grind stone and then grinding the sliced end of said cylindrical-shaped material with said grind stone while rotating said cylindrical material.

2. A wafer slicing method as set forth in claim 1, wherein said cylindrical material is fed a predetermined amount in the direction of the thickness of said sliced thin piece before or after the axis of said cylindrial material is matched with said annular grinding section of said cup-shaped grind stone.

* * * * *

UNITED STATES PATENT AND TRADEMARK OFFICE

CERTIFICATE OF CORRECTION

PATENT NO. : 4,894,956

DATED : January 23, 1990

INVENTOR(S) : Katsuo Honda; Susumu Sawafuji

It is certified that error appears in the above-identified patent and that said Letters Patent is hereby corrected as shown below:

ON THE COVER PAGE:

[73] Assignee:

change "Tokyo Semitsu Co., Ltd., Japan" to --Tokyo Seimitsu Co., Ltd., Japan--.

Signed and Sealed this

Third Day of December, 1991

*Attest:*

HARRY F. MANBECK, JR.

*Attesting Officer*

*Commissioner of Patents and Trademarks*